US007261339B2

(12) United States Patent
Kiehl

(10) Patent No.: US 7,261,339 B2
(45) Date of Patent: Aug. 28, 2007

(54) DEVICE FOR ACTUATING LOCKS ON DOORS OR HATCHES OF VEHICLES

(75) Inventor: Erik Kiehl, Ratingen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 2 days.

(21) Appl. No.: 11/173,678

(22) Filed: Jun. 30, 2005

(65) Prior Publication Data

US 2006/0012185 A1 Jan. 19, 2006

(30) Foreign Application Priority Data

Jul. 13, 2004 (DE) ..... 10 2004 033 735

(51) Int. Cl.
*E05C 3/06* (2006.01)

(52) U.S. Cl. ..... 292/216; 292/201

(58) Field of Classification Search ..... 292/164, 292/216, 201, 2

See application file for complete search history.

(56) References Cited

U.S. PATENT DOCUMENTS 3,666,305 A * 5/1972 Schlichter ..... 292/48
6,076,868 A * 6/2000 Roger et al. ..... 292/201
6,109,671 A 8/2000 Roncin et al.
6,382,687 B1 * 5/2002 Gruhn ..... 292/201
6,390,517 B1 * 5/2002 Ehret ..... 292/201
6,435,573 B1 * 8/2002 Szablewski ..... 292/201
6,557,910 B2 * 5/2003 Amano ..... 292/201
2005/0167990 A1 * 8/2005 Orzech et al. ..... 292/201

FOREIGN PATENT DOCUMENTS

DE 38 01 158 7/1989

* cited by examiner

*Primary Examiner*—Brian E. Glessner
*Assistant Examiner*—Mark Williams
(74) *Attorney, Agent, or Firm*—Friedrich Kueffner

(57) ABSTRACT

A device for actuating locks on a vehicle door has a rotary latch spring-loaded into an open position. When the door is closed, the rotary latch receives a lock member of the lock and is rotated into a defined locked position. The rotary latch has a detent into which a pivotable catch drops in a blocking position for securing the locked position of the rotary latch. A catch spring forces the catch into the blocking position. An actuation is provided for lifting the catch from the blocking position into a release position for releasing the rotary latch. The catch spring is an over-center helper spring that reverses a direction of action of the spring force. The catch spring acts as a snow load device that holds the catch in the release position until the rotary latch has reached the open position.

12 Claims, 7 Drawing Sheets

DEVICE FOR ACTUATING LOCKS ON DOORS OR HATCHES OF VEHICLES

BACKGROUND OF THE INVENTION

1. Field of the Invention

The invention relates to a device for actuating locks on hatches or doors of vehicles, comprising a rotary latch in the lock that is spring-loaded into its open position, wherein the rotary latch, when the hatch or the door is closed, receives a lock member provided stationarily on the vehicle and is rotated into at least one defined position (locked position). The device further comprises a detent on the rotary latch into which, upon rotation of the rotary latch, a catch, pivotably and stationarily supported in the lock, drops so as to define a blocking position of the catch and to secure the locked position of the rotary latch. The device further comprises a catch spring that forces the catch into the blocking position. An actuation that is operated manually or by means of a motor is provided for lifting the catch from its blocking position into a release position in which the rotary latch is released. A snow load device is provided in the lock which, when actuated, holds the catch in the release position until the rotary latch has reached its open position.

2. Description of the Related Art

The classical components of a lock include a spring-loaded rotary latch which upon closing of the door cooperates with a stationary lock member and a spring-loaded, pivotably supported catch that, when closing the door, drops into at least one detent of the rotary latch. The described device also includes a so-called snow load device. The snow load device is needed when upon electric and/or manual actuation of the catch the rotary latch remains in its locked position and does not release the lock member. Despite actuation, the door cannot be opened in this situation.

This "snow load situation" occurs for a lock arranged on the rear hatch of a vehicle when a snow load is present on the closed rear hatch. The weight of the snow presses the rear hatch so tightly into the lock member that the return force of the seal and/or the spring load is not sufficient for transferring the rotary latch into the open position. The term "snow load situation" has been derived from this situation. Without a snow load device, the catch would be returned by the catch spring into the blocking position so that it drops into a detent of the rotary latch and therefore secures the rotary latch again in the locked position.

The snow load device has the task of securing the catch in the release position caused by its actuation until the rotary latch has actually reached its open position. The result is that after removal of the snow load from the rear hatch the already released rotary latch is returned by its spring load into the open position without this requiring renewed actuation.

Aside from such a snow load situation there are also other disturbance situations in these devices where the use of such snow load devices is very desirable. In the case of rotary latches that have in addition to the so-called main detent also a pre-detent, it can occur that a rotary latch that is secured by the catch in its main detent will not return quickly enough upon actuation of the catch into its open position but instead its pre-detent is engaged by the catch. It is then necessary to actuate the catch again; this is perceived as cumbersome. In this situation, such a snow load device is also helpful.

Locking devices with snow load devices of this kind are known in various embodiments. The device according to German patent 38 01 158 C1 requires several parts for securing the catch in its release position, e.g. a blocking lever with a stop arm, a driver pin on the rotary latch, and an auxiliary lever. The known snow load devices are expensive and require a large space.

U.S. Pat. No. 6,109,671 discloses a lock in which the force of the catch spring acts always in the same direction on the catch; however, this force can be made inactive by providing additional safety means. These safety means are comprised of a U-shaped hook bracket on a driver that is connected fixedly to the catch and of control surfaces as well as a projection on the rotary latch. In the snow load situation, the hook bracket engages from behind the projection so that the driver is supported on the rotary latch and generates a spacing between the rotary latch and the catch. The force of the catch spring that is still active in the snow load situation is transmitted by the driver onto the rotary latch. These securing means take up a large space within the lock.

SUMMARY OF THE INVENTION

It is an object of the present invention to develop a reliable device of the aforementioned kind that is small in size and saves space and is inexpensive.

In accordance with the present invention, this is achieved in that the catch spring is configured as an over-center helper spring that, when the catch moves between its blocking position and its release position, reverses the direction of its spring force and in that the snow load device consists only of the over-center helper spring that interacts with the catch and with the rotary latch.

The invention proposes that the catch spring is a so-called over-center helper spring. When the catch moves between its blocking position and its release end position, this over-center helper spring changes the direction of its spring force. While the catch in the blocking position is loaded by the over-center helper spring in the direction toward the rotary latch, in the release end position the spring force is oriented away from the rotary latch. In the present invention, the snow load device is practically comprised only of the over-center helper spring that interacts with the catch and with the rotary latch.

This is sufficient for configuring a snow load device. According to the invention, the snow load device requires no additional components. It is sufficient to have available the elements that are present within a lock in any case, i.e., the catch, the catch spring, and the rotary latch. Accordingly, the special components of the known snow load devices as disclosed in the art are no longer needed. Not only is it no longer required to produce and mount these special components, but valuable space within the lock is made available. The invention is of a very simple configuration so that the device will cause no disruptions or failure. The device according to the present invention functions very reliably.

In the context of the invention, when the term door is used, it is to be understood to encompass any type of hatch, door or door-like closure device of a vehicle that is provided with a lock.

Such an over-center helper spring has two spring ends, wherein the first spring end engages the catch and forms a moving end of the spring that can be moved together with the catch, wherein the second spring end is stationary within the lock and provides a fixed spring end of the over-center helper spring. An imaginary straight connecting line between the pivot bearing of the catch and the fixed end of the over-center helper spring determines a dead-center line for the over-center helper spring. The moving end of the over-center helper spring upon pivoting of the catch crosses the dead-center line and determines on opposed sides of the dead-center line two stable end positions of the over-center helper spring. The over-center helper spring in the first end position generates on the catch a (first) torque and in the second end position generates on the catch an oppositely oriented (second) counter torque, wherein the first torque forces the catch into its blocking position and the second (counter) torque forces the catch into its release position.

Additional features and advantages of the invention result from the dependent claims, the following description, and the drawings. The drawings show three embodiments of the invention. Only those components essential for understanding the invention are illustrated. The device according to the invention is configured in other respects as is customary in the art.

DESCRIPTION OF THE PREFERRED EMBODIMENTS

Figure 6:
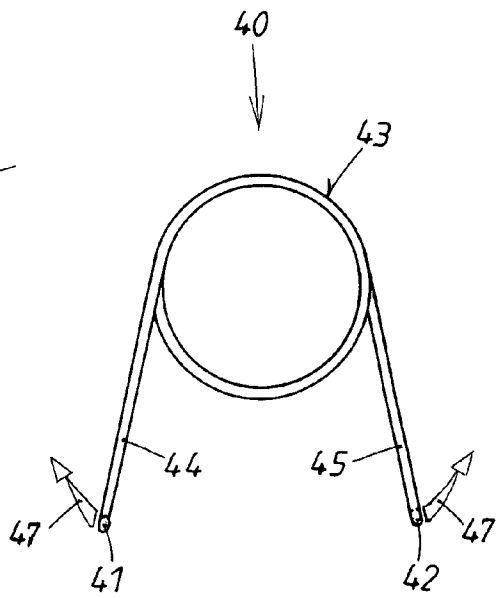
FIG. 6 shows as a detail view of FIG. 1 an important component of the device according to the invention, the catch spring, in the form of a tangentially loaded helical spring removed from the lock.

When supposing that each lock of the inventive kind comprises a rotary latch 20 and a catch 30, a snow load device 10 is comprised according to the invention only of the special configuration of the catch spring 40, i.e., it is a so-called over-center helper spring. As already mentioned, in the first embodiment this over-center helper spring is a tangentially loaded helical spring ("leg spring"). Since each lock requires a single catch spring 40, it can be said that the snow load device according to the invention is characterized by the special feature of requiring no additional lock parts.

The rotary latch 20 is supported so as to rotate on a stationary rotary pin 21 in the lock housing (not illustrated in detail) and is exposed to the action of a spring load that is illustrated by the arrow 22. This spring load 22 has the effect of transferring the rotary latch 20 into the open position illustrated in FIG. 5 by the auxiliary line 20.1. This open position 20.1 is determined in that the rotary latch 20 rests against a stationary stop 12 in the lock housing. The lock illustrated in the Figures is mounted on a rear hatch of a vehicle (not illustrated) but could also be provided alternatively on a door.

Figure 5:
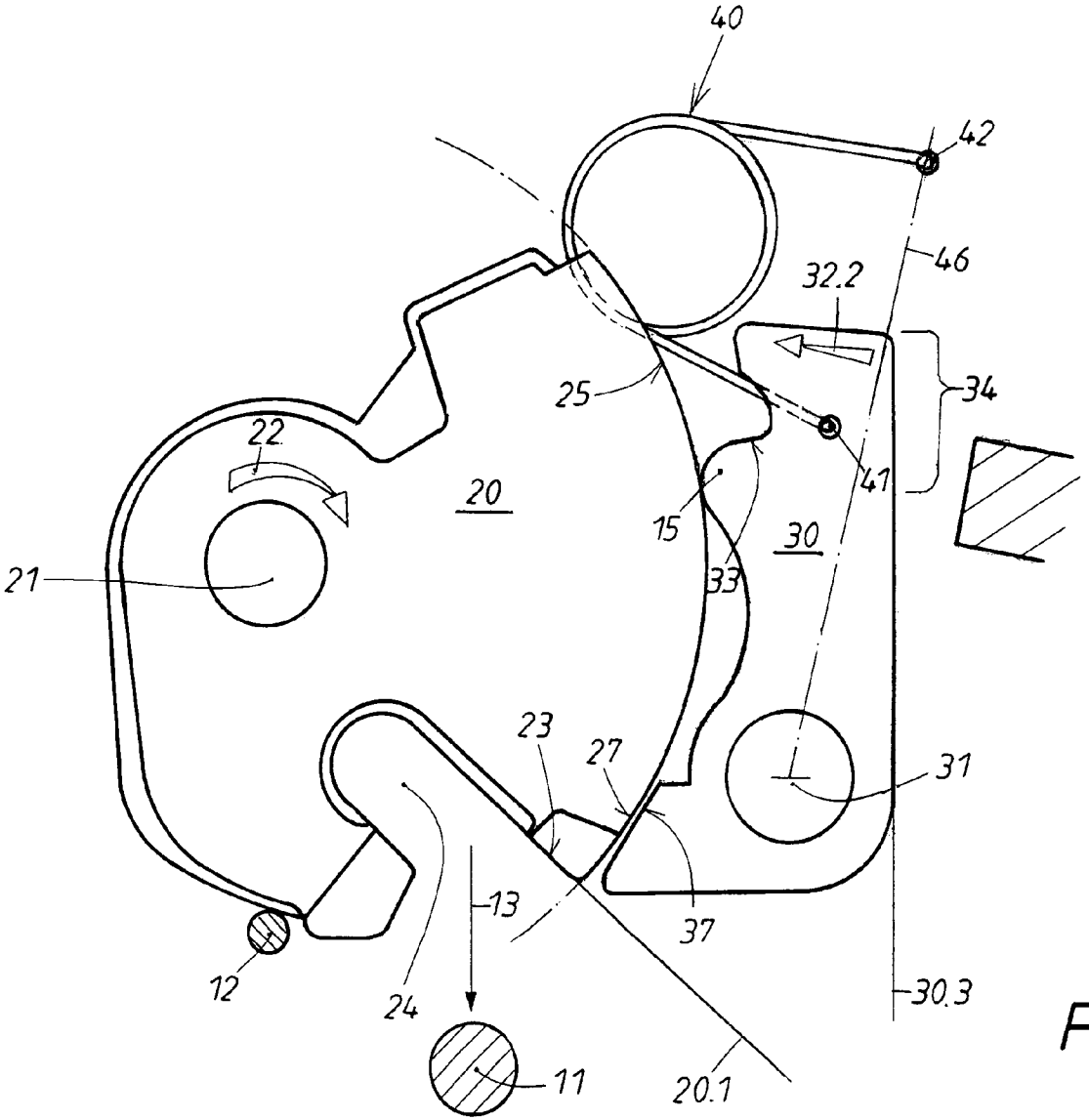
FIG. 5 shows in a view like that of FIG. 1 a fourth sequential intermediate position of the lock parts wherein the rotary latch is in the open position and the catch is in a ready position characterizing the door or hatch being open.

The open position 20.1 of the rotary latch 20 shown in FIG. 5 characterizes the position of the opened rear hatch. A lock member 11 that is stationarily mounted on the vehicle is aligned with the opening of a cutout 24 provided within the rotary latch 20. When the rear hatch is closed in the direction of arrow 13 of FIG. 5, the lock member 11 reaches the cutout 24 of the rotary latch 20 and moves the rotary latch 20 against its spring load 22 into different locking positions. For this purpose, rotary latches have so-called pre-detents and main detents. In the present embodiment, only a single detent 23 is illustrated on the rotary latch 20.

Figure 1:
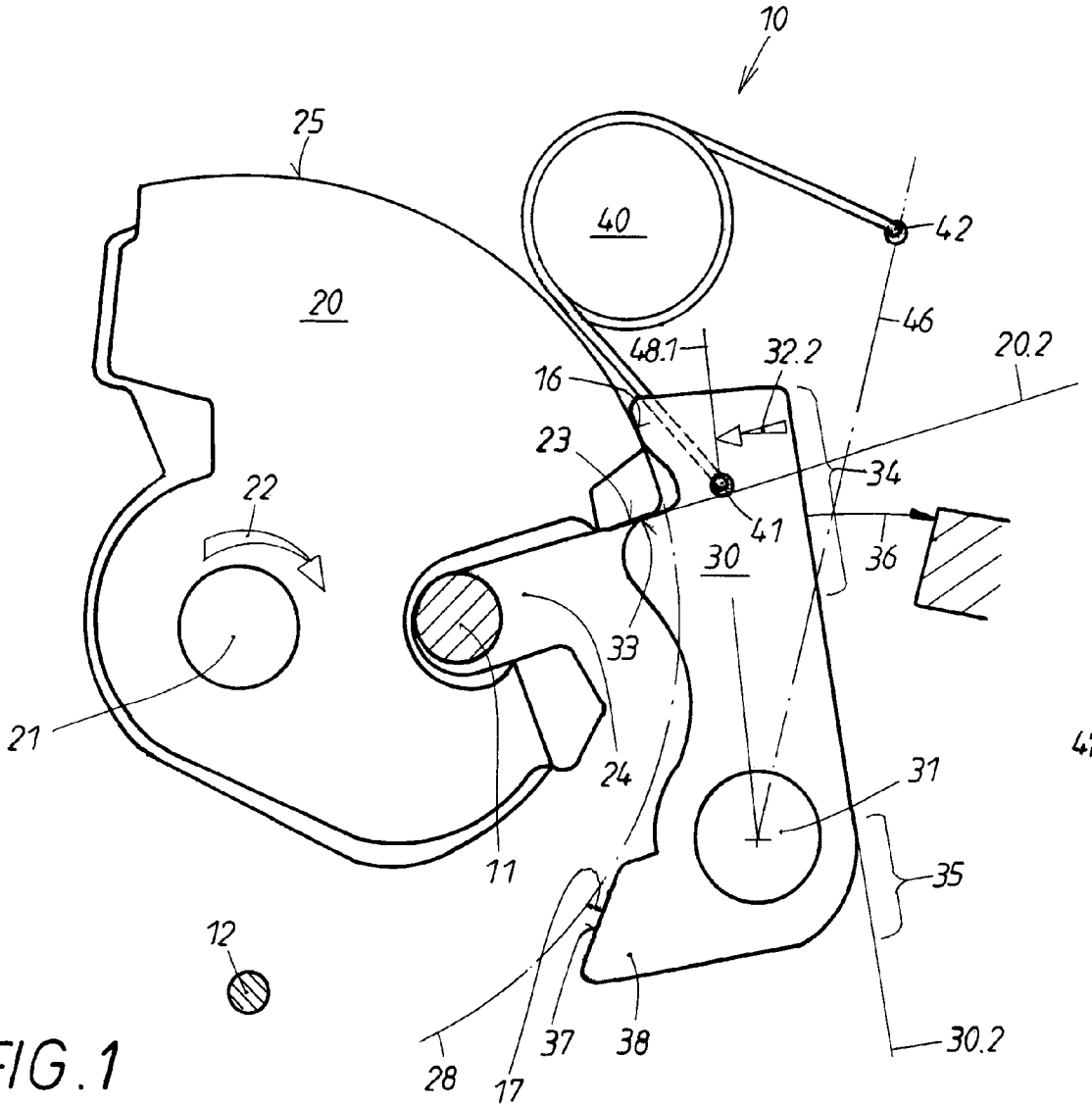
FIG. 1 shows a first embodiment of the invention wherein, without illustrating the lock housing, the most important lock parts arranged therein are illustrated in a locked position of a rotary latch and in a blocking position of the catch.

When locking the rear hatch manually or by means of a motor, the rotary latch 20 reaches its locked position illustrated in FIG. 1 where the engaged lock member 11 has been entrained deep into the interior of the lock. This locked position of the rotary latch 20 is marked in FIG. 1 by the auxiliary line 20.2. This locked position 20.2 is secured by means of the already mentioned catch 30. As illustrated in FIG. 1, the catch 30 is pivotably supported on a pin 31 that is also stationarily mounted in the lock housing. The catch 30 is spring-loaded in the first embodiment by a tangentially loaded helical spring 40 that, according to the invention, functions as an over-center helper spring. The special action of such an over-center helper spring 40 is explained in connection with FIG. 6.

The over-center helper spring 40 embodied in the first embodiment as a tangentially loaded helical spring is comprised of a coil 43 from which two legs 44, 45 project. The free ends of these legs 44, 45 form two spring ends 41, 42 of which one spring end 41 engages the catch 30 and therefore is entrained when the catch 30 is pivoted; this end is referred to in the following as the moving end. The other spring end 42, on the other hand, is stationarily supported in the lock housing and is at rest. It is therefore referred to as the fixed end of the over-center helper spring 40. The over-center helper spring 40 always exerts a spring force that has the effect of spreading apart the two legs 44, 45. This is illustrated by the force arrows 47 in FIG. 6.

The over-center helper spring 40 has a so-called dead center line 46 relative to which the moving end 41 can be positioned in two opposed positions. The dead center line 46 is determined by an imaginary straight connecting line between the pivot support 31 of the catch 30 and the fixed end 42 of the over-center helper spring 40. As a function of the different pivot positions, different actions occur on the catch 30.

When the locked position 20.2 of the rotary latch 20 according to FIG. 1 is present, the moving end 41 is on the side of the dead center line 46 proximal to the rotary latch 20. In this situation, the spring forces 47 that have already been explained in connection with FIG. 6 exert a torque onto the catch 30 which is illustrated by the arrow 32.2 of FIG. 1. This torque 32.2 loads the catch 30 in the counterclockwise direction and ensures that a counter detent 33 provided on the arm 34 of the catch 30 engages the detent 23 provided on the rotary latch 20. Because of the torque 32.2, the catch 30 provides a locking action spring-loaded by the over-center helper spring 40.

The position illustrated in FIG. 1 therefore represents the blocking position of the catch 30 that is illustrated also by means of the auxiliary line 30.2. The moving end 41 of the over-center helper spring 40 is in the first stable end position that is marked by the auxiliary line 48.1. An actuation that is effected manually or by means of a motor is provided for the device according to the invention; this actuation allows the catch 30 to be lifted out of the blocking position 30.2 in the direction of the actuating arrow 36 illustrated in FIGS. 1 and 2. When no snow load situation (to be explained in more detail in the following) is present and the catch 30 is actuated, the intermediate unstable position 30.0 of the catch 30 illustrated in FIG. 2 results.

Figure 2:
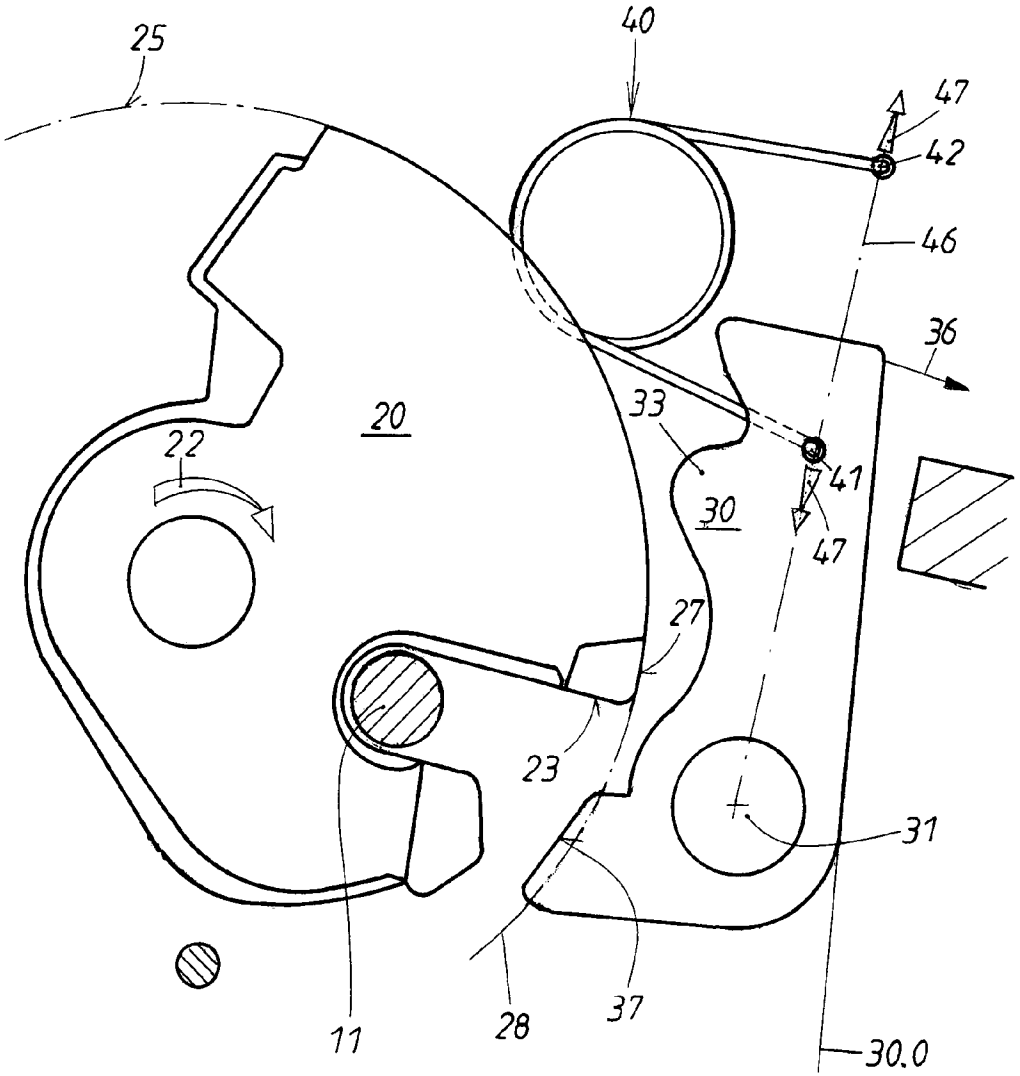
FIG. 2 illustrates in a view like that of FIG. 1 a first sequential intermediate position of the lock parts after actuation of the catch before reaching its release position (illustrated is a normal situation, not a snow load situation)

In the intermediate position 30.0 of FIG. 2, the moving end 41 of the over-center helper spring 40 is located on the dead center line 46. The spring forces 47 now positioned on the dead center line 46 cancel one another. In this dead center position 30.0, the catch 30 is not loaded by forces. The catch 30 is moved manually or by means of a motor across the dead center position 30.0 and projects already in the dead center position with a control surface 37 into the rotary path of the circumferential contour 25 of the rotary catch 20; this rotary path is illustrated in a dash-dotted line in FIG. 2. Accordingly, the catch 30 reaches finally the release end position 30.1 illustrated in FIG. 3; this release end position is delimited by the end stop 14 for the catch 30. Already in the position of FIG. 2, the catch 30 has released the detent 23 of the rotary latch 20 because its counter detent 33 is positioned at a spacing from the circumferential contour 25 of the rotary latch 20. The resulting consequences will be explained in more detail in the following.

Figure 3:
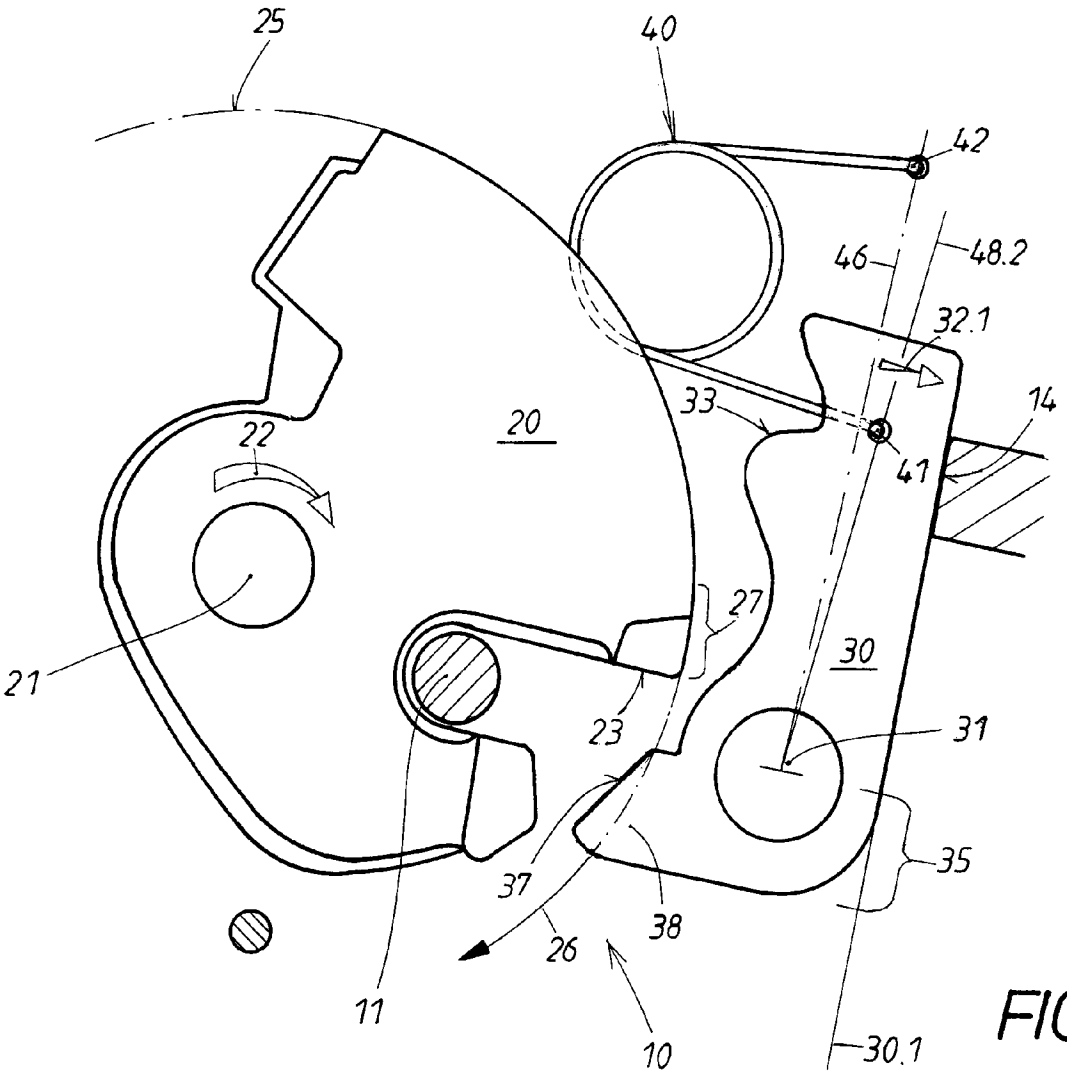
FIG. 3 illustrates in a view like that of FIG. 1 a second sequential intermediate position of the lock parts where the catch has reached its release position after actuation of the catch (in the normal situation, the rotary catch returns because it is spring-loaded but in the snow load situation the catch is in the position of FIG. 3 while the rotary latch is still in the locked position of FIG. 1)

In the release end position 30.1, the moving end 41 of the over-center helper spring 40 is located relative to the dead center line 46 on the side remote from the rotary latch 20. Because of the stop 14 for the catch, a second end position marked in the drawing by the auxiliary line 48.2 of the moving end 41 is thus present. The force conditions that have been explained in connection with FIG. 6 in more detail cause a counter torque that is illustrated in FIG. 3 by arrow 32.1 and acts in the clockwise direction. This counter torque 32.1 is opposite to the torque 32.2 described in connection with FIG. 1.

As already mentioned, the catch 30 has released the rotary latch 20 in its dead center position 30.0 of FIG. 2 as well as in its release position 30.1 of FIG. 3. The elastic action of the elastic door seal forces the lock member away so that the rotary latch 20 is rotated by utilizing the spring load 22 acting on it.

However, the special snow load situation mentioned above can occur in which the rotary latch 20, even after release of the catch 30 according to FIG. 3, is still in the locked position 20.2 of FIG. 1. Aside from other causes, as has already been explained above, it can happen that the rotary catch 20 cannot rotate fast enough in order to move its detent 23 past the counter detent 33 of the catch 30, as illustrated e.g. in FIG. 2. In this situation, if the counter torque 32.1 were not generated in accordance with the present invention as explained in FIG. 3, the catch 30 would drop into the detent 23 or another detent, for example, a pre-detent of the rotary latch 20. This would constitute the situation according to the prior art without a snow load device. It would not be possible to open the door or rear hatch.

Because of the counter torque 32.1 in FIG. 3 that acts always in the release direction of the catch 30, this is not the case. The catch 30 is secured in its release end position 30.1. The catch 30 remains in this release end position 30.1 until the latch 20 has reached the open position 20.1 illustrated in FIG. 5. This is realized automatically because the snow load device 10 according to the present invention additionally has profiles 37, 27 provided on the rotary latch 20 and the catch 30.

Figure 4:
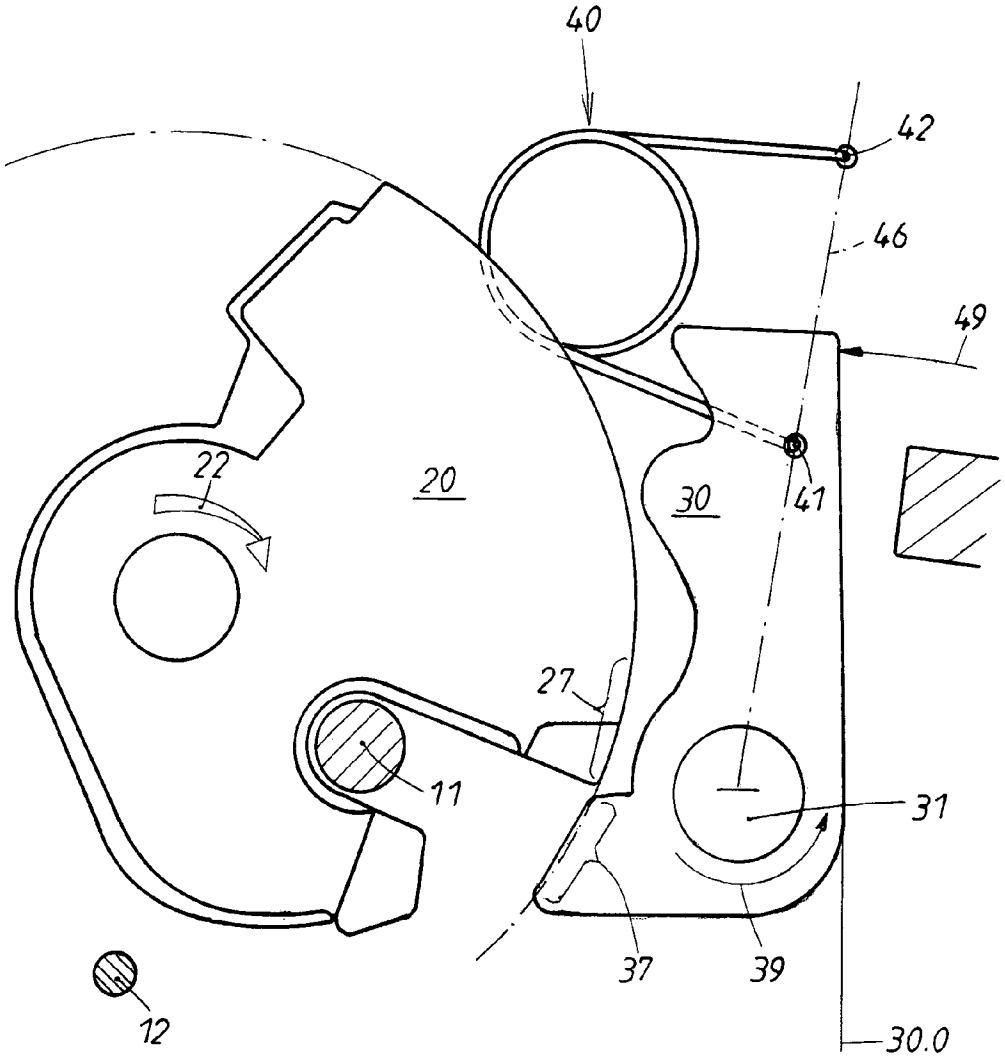
FIG. 4 illustrates in a view like that of FIG. 1 a third sequential intermediate position of the lock parts when the rotary latch returns into an open position, wherein the control surfaces of the rotary latch interact with the catch and an intermediate position of the catch results that is similar to that of FIG. 2.

The catch 30 has in addition to the arm 34 with locking effect also a counter arm 35 on its opposite side relative to the pivot bearing 31. On the counter arm 35 a control surface 37 is provided in the form of an angled projection 38. In the present case, the already mentioned circumferential contour 25 of the rotary latch 20 is a circle relative to the rotary pin 21. The rotary path resulting when the rotary latch 20 finally returns in the direction of the movement arrow 26 of FIG. 3 is illustrated in dash-dotted lines in FIG. 2 and FIG. 3. In this connection, the circumferential contour 25 of the rotary latch 20 moves with its leading part functioning as a counter control surface 27 against the control surface 37 of the catch 30. The counter control surface 27 strikes the control surface 37 on the catch 30. Accordingly, the catch 30 is forcibly moved in the counterclockwise direction according to movement arrow 39 illustrated in FIG. 4 against the torque 32.1 exerted on it.

FIG. 4 shows again an unstable boundary condition where the catch 30 is in the already described dead center position 30.0. In this case, an interaction of the control surface 37 and of the counter control surface 27 is ensured until the rotary latch 20 has reached actually the stop 12 and is in the open position 20.1 illustrated in FIG. 5. The lock member 11 is released (illustrated in FIG. 5).

FIG. 5 shows that the moving end 41 of the over-center helper spring 40 is again located on the side of the dead center line 46 proximal to the rotary latch 20. Similar conditions as in FIG. 1 are present. The over-center helper spring 40 generates torque 32.2 acting in the counterclockwise direction. By means of this torque 32.2, the catch 30 is supported with spring action by means of its edge 15 on the circumferential contour 25 of the rotary latch 20. This edge 15 is provided on the arm 34 of the catch 15 where the counter detent 33 is provided. The catch 30 is in its ready position, i.e., it is ready to engage the detent 23 of the rotary latch 20 because of the torque 32.2 acting on it when the rotary latch 20 has been moved into the locked position explained in connection with FIG. 1. Accordingly, the position of the catch 30 illustrated by auxiliary line 30.3 in FIG. 5 can be identified as its ready position. In the ready position 30.3 shown in FIG. 5, there is already an air gap between the control surface 37 of the catch 30 and the counter control surface 27 of the rotary latch 20.

In the locked position 20.2 of the rotary latch 20, the engagement depth of the counter detent 33 of the catch 30 in the detent 23 can be limited by a shoulder 16 that is supported in a springy fashion on a matching counter shoulder of the rotary latch 20 because of the described catch torque 32.2. This is illustrated in FIG. 1. In the present case, this counter shoulder is formed by the circumferential contour 25 of the rotary latch 20.

The invention is not only of interest for a snow load situation. With the device according to the invention, the rotary latch 20 has always sufficient time as a result of its spring load 22 for moving from its locked position 20.2 of FIG. 1 into is open position 20.1 of FIG. 5. The catch "waits" until the rotation of the rotary latch 20 has been completed. Only thereafter, it moves into its ready position 30.3 illustrated in FIG. 5.

Figure 7:
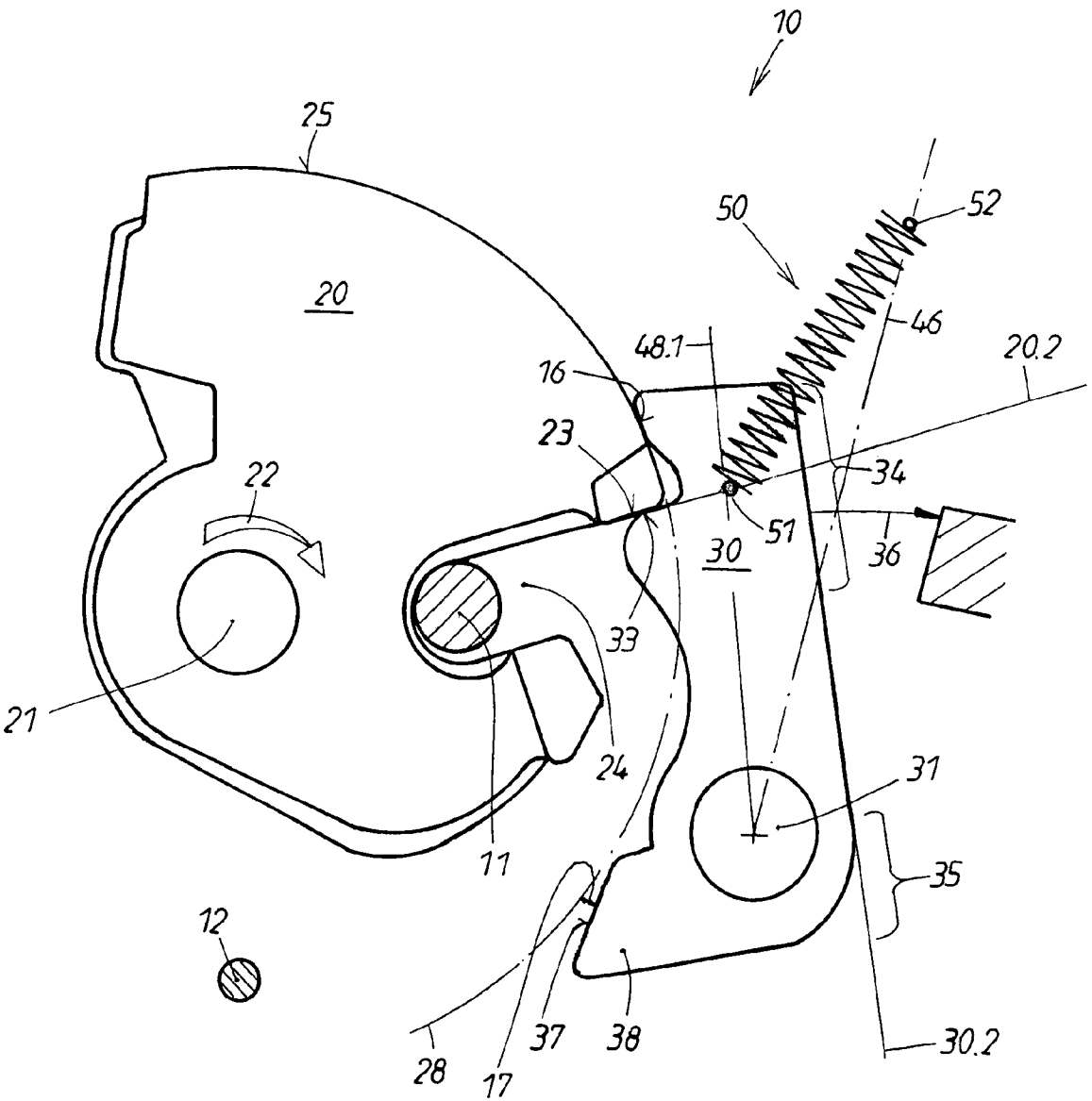
FIG. 7 shows in a view like that of FIG. 1 a second embodiment of a catch spring in the form of a pressure spring, wherein the pressure spring causes the same actions as the catch spring of FIG. 6 within the device of FIG. 1 so that the operation of the device as described in connection with FIGS. 1 to 5 also applies to the spring of FIG. 7.
Figure 8:
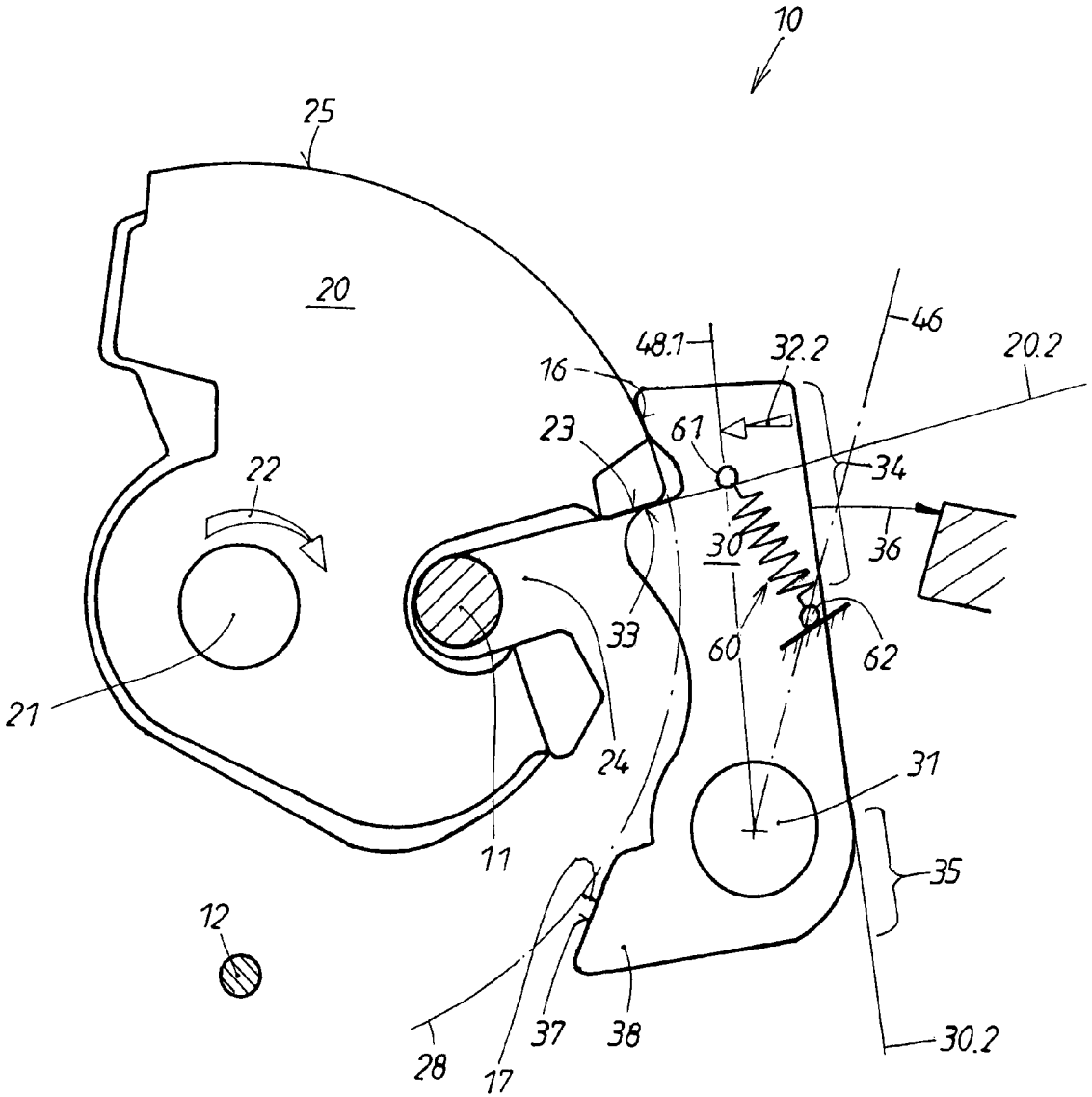
FIG. 8 shows in a view like that of FIG. 1 a third embodiment of the catch spring in the form of a tension spring, wherein the tension spring causes the same actions as the catch spring of FIG. 6 within the device of FIG. 1 so that the operation of the device as described in connection with FIGS. 1 to 5 also applies to the spring of FIG. 8.

As already mentioned, FIGS. 7 and 8 show two alternative embodiments of an over-center helper spring. FIG. 7 shows as an over-center helper spring a pressure spring 50 that is supported by means of a fixed end 52 located on the dead center line 46 described in accordance with the first embodiment. The other spring end 51 engages the catch 30 and functions therefore as the moving end. Analog effects as described in connection with the first embodiment will take place.

The latter holds true also for the third embodiment according to FIG. 8. The over-center helper spring is embodied as a tension spring 60 whose ends 61, 62 engage the device as illustrated in FIG. 8. The first end 61 is arranged to be movable with the catch 30 and is therefore referred to as the moving end. The second spring end 62 is stationary and is located on the dead center line 46 that has been mentioned above. The end 62 is therefore the fixed end of the tension spring 60.

While specific embodiments of the invention have been shown and described in detail to illustrate the inventive principles, it will be understood that the invention may be embodied otherwise without departing from such principles.

What is claimed is:

1. A locking device for a vehicle, the device comprising:

a lock on a door or hatch of the vehicle, the lock having a rotary latch and spring-loaded into an open position, wherein the rotary latch, when the door is closed, receives a stationary lock member fixed to the door and is rotated into at least one defined locked position, wherein the rotary latch has at least one detent;

a catch pivotably supported in the lock, wherein the catch, upon rotation of the rotary latch, drops into the at least one detent of the rotary latch and defines a blocking position of the catch for securing the locked position of the rotary latch;

a catch spring having a spring force and forcing the catch in a defined direction into the blocking position;

the catch being movable from the blocking position into a release position in which the rotary latch is released;

wherein the catch, when actuated, is held in the release position until the rotary latch has reached the open position;

wherein the catch spring is an over-center helper spring, and the direction of the spring force of the over-center helper spring is changeable in dependence on the position of the catch;

wherein, in the blocking position of the catch, the spring force is directed toward the rotary latch and, in the release position, the spring force is directed away from the rotary latch; and wherein the direction of action of the spring force changes when the catch moves from the blocking position to the release position, and when during turning back of the rotary latch the rotary latch collides with the catch to move from the release position to the blocking position.

2. The device according to claim 1, wherein the over-center helper spring has a first spring end and a second spring end, wherein the first spring end engages the catch and provides a moving end of the over-center helper spring which moving end is moved together with the catch, wherein the second spring end is stationary within the lock and provides a fixed spring end of the over-center helper spring, wherein an imaginary straight connecting line between a pivot bearing of the catch and the fixed spring end determines a dead-center line of the over-center helper spring, wherein the moving end of the over-center helper spring upon pivoting of the catch crosses the dead-center line and defines on opposed sides of the dead-center line a first stable end position and a second stable end position of the over-center helper spring, wherein the over-center helper spring in the first stable end position generates a first torque acting on the catch and in the second stable end position generates a second torque acting on the catch, wherein the second torque is oppositely oriented relative to the first torque, wherein the first torque forces the catch into the blocking position and the second torque forces the catch into the release position.

3. The device according to claim 2, wherein the catch has a control surface and wherein the rotary latch has a counter control surface, wherein in the release position the control surface of the catch projects into a rotary path of the counter control surface of the rotary latch, wherein in the blocking position the control surface of the catch is located outside of the rotary path of the counter control surface of the rotary latch.

4. The device according to claim 3, wherein the rotary latch has a circumferential contour that forms the counter control surface of the rotary latch.

5. The device according to claim 3, wherein the catch has a dead center position in which the moving end of the over-center helper spring is located on the dead center line, wherein in the dead center position the control surface of the catch is already located in the rotary path of the counter control surface of the rotary latch.

6. The device according to claim 3, wherein the control surface of the catch is a projection provided on the catch.

7. The device according to claim 6, wherein the catch has a pivot axis and, relative to the pivot axis, has a first arm and a second arm, wherein the first arm has a counter detent engaging the at least one detent of the rotary latch in the blocking position, wherein the projection is provided on the second arm.

8. The device according to claim 2, wherein the catch in the release position rests against a stationary stop of the lock, wherein the stationary stop takes up the second torque and determines the second stable end position of the over-center helper spring.

9. The device according to claim 2, wherein the catch has a shoulder and the first torque causes the catch in the blocking position to be supported by the shoulder on a circumferential contour of the rotary latch.

10. The device according to claim 1, wherein the over-center helper spring is a tangentially loaded helical spring.

11. The device according to claim 1, wherein the over-center helper spring is a pressure spring.

12. The device according to claim 1, wherein the over-center helper spring is a tension spring.

* * * * *